United States Patent [19]

Talbert

[11] 4,405,664

[45] Sep. 20, 1983

[54] EXHIBIT OF A DECORATIVE ART WORK

[76] Inventor: Lisa M. Talbert, 355 Folkstone Way, York, Pa. 17402

[21] Appl. No.: 334,600

[22] Filed: Dec. 28, 1981

Related U.S. Application Data

[62] Division of Ser. No. 263,255, May 13, 1981.

[51] Int. Cl.[3] ..... A47G 1/12

[52] U.S. Cl. ..... 428/14; 428/13; 428/912.2; 428/913; 428/913.3

[58] Field of Search ..... 428/13, 912.2, 913, 428/913.3, 14, 34

[56] References Cited

U.S. PATENT DOCUMENTS 2,506,165 5/1950 Mountcastle ..... 427/272

4,262,042 4/1981 Bruskin ..... 427/275

*Primary Examiner*—Marion McCamish

*Attorney, Agent, or Firm*—Bacon & Thomas

[57] ABSTRACT

A method of making and exhibiting a decorative art work, particularly paintings or the like, wherein an outline of a desired design is first applied to a surface of a light transparent softenable substrate, such as a thermoplastic polymer. Portions of the substrate at the outline are thereafter softened through the application of heat or solvent and decorative materials, such as paint or reflective particles, are embedded within and encapsulated by the softened substrate to provide a design having depth of field and a substantially three-dimensional configuration when light is directed through the substrate from at least one direction.

5 Claims, 5 Drawing Figures

EXHIBIT OF A DECORATIVE ART WORK

This application is a division, of application Serial No. 263,255, filed May 13, 1981

BACKGROUND OF THE INVENTION

1. Field of the Invention

This invention generally relates to the making of decorative art works. More particularly, the invention relates to an improved method for creating and exhibiting a painted design.

2. Description of the Prior Art

The method of creating works of art by applying one or more layers of decorative materials on a substrate, such as canvas, paper, wood or the like is well known. A painting is generally defined by layers and mixtures of different colored paints which collectively serve to present a desired design. Such known designs are essentially two-dimensional or flat in appearance and do not suggest a depth of field or three-dimensional configuration, regardless of the direction of viewing or source of illumination. Moreover, paintings made on traditional substrates, such as canvas or paper, generally experience physical deterioration upon aging due primarily to excessive drying of the paints and thermal differential stresses which cause cracking and crazing of the painted design.

It has been proposed to create painted designs on rigid light transparent substrates through physical alteration of such substrates in order to suggest a sense of depth for such designs. Similarly, art works have been created by overlying several layers of rigid colored material on transparent bases to produce design configurations suggesting three-dimensional shapes. However, such prior art efforts have not been altogether successful in both creating a durable painted work of art having a decided three-dimensional depth of field and providing a system of illumination for optimally exhibiting this highly desirable visual effect.

SUMMARY OF THE INVENTION

It is an object of the present invention to provide an improved system for both making and exhibiting a decorative art work.

It is another object of the invention to provide an improved method of creating a painted design having both depth of field and a three-dimensional configuration.

It is a further object of the invention to provide a system for making a painted art work that is substantially permanent in nature and resistant to deterioration over a long period of time.

It is still another object of the invention to provide an improved system for illuminating and exhibiting a painted work of art for optimal display effect.

The present invention achieves these and other objects by providing an improved method of creating a decorative art work wherein an outline of a desired design is initially formed on a surface of a light transparent softenable substrate, such as a sheet of thermoplastic polymer. Portions of the substrate at the outline are then softened through the application of heat or solvent. Decorative materials, such as paints and reflective particles, are then embedded within the softened portions of the substrate and below the surface thereof such that the substrate encapsulates the decorative materials so that portions of the finished design become integrated with the substrate material itself. Additional layers of decorative materials are then applied to the surface of the substrate to fulfill the outline of the design, with the finished art work being defined as a painted design having a three-dimensional configuration and depth of field when illuminated from at least one direction. Illumination is preferably provided from three different directions, such as front, back and one side of the substrate. The invention further provides means for optimally exhibiting an art work created according to the invention wherein light is reflected from the peripheral edge of the substrate and directed radially inwardly towards the center portion thereof to provide illumination of the entire substrate for viewing the art work from a direction substantially perpendicular to an exposed surface of the substrate.

Other objects, features and advantages of the invention will become apparent from the following description of specific embodiments thereof, with reference to the accompanying drawings which form a part of the specification, wherein like reference characters designate corresponding parts of the several views.

DETAILED DESCRIPTION OF THE PREFERRED EMBODIMENTS

Figure 1:
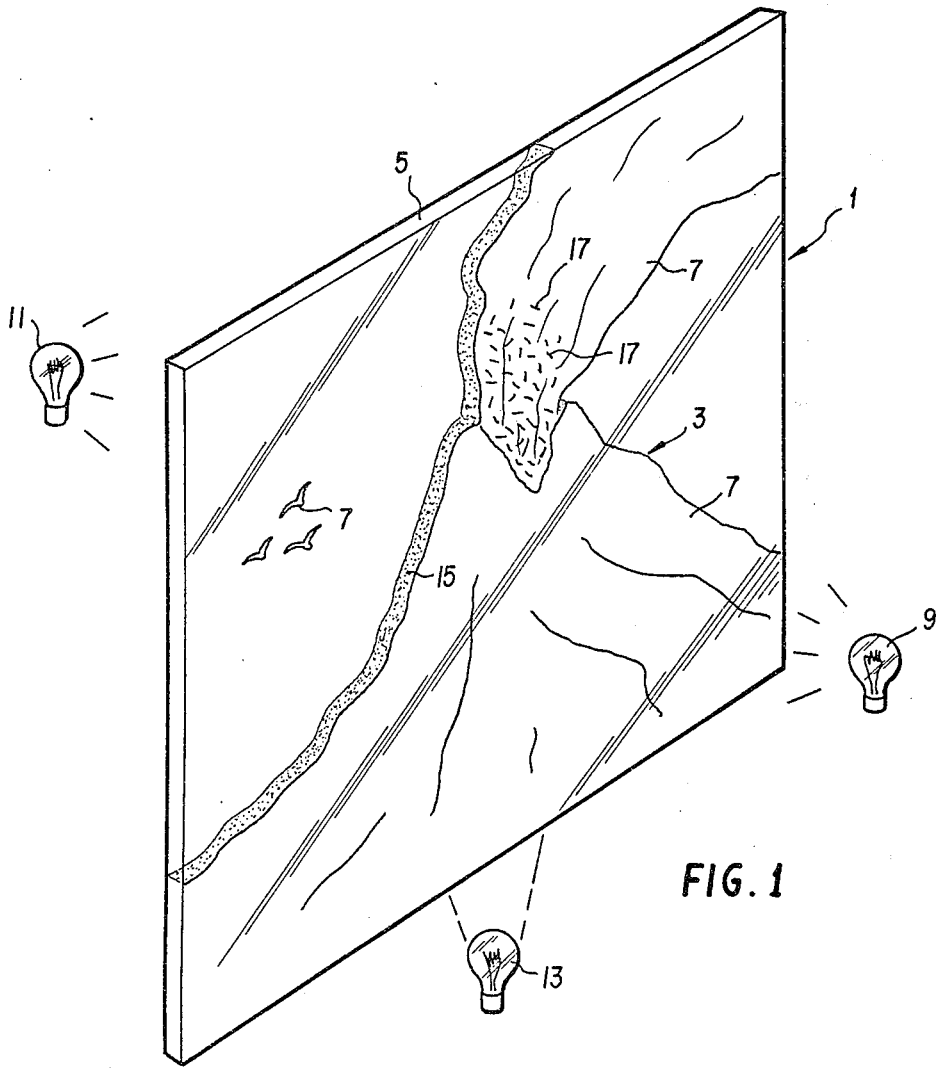
FIG. 1 is a perspective view of a painted art work made according to the invention and shown illuminated from three different directions.

A painted art work 1 made according to the invention is shown in FIG. 1. Art work 1 includes a design 3 formed by coating a substrate with plural layers of paints 7 which collectively define design 3. Substrate 5 is made from a material which is softenable and capable of transmitting light therethrough, such as transparent or translucent plastic. A preferred form of substrate 5 would be a sheet of thermoplastic material, such as acrylic plastic, which can be softened by the application of heat or solvent. As also shown in FIG. 1, art work 1 is provided with illumination from three different directions. A light source 9 provides illumination from the front, a light source 11 provides illumination from the rear, and a light source 13 provides illumination from one peripheral edge of substrate 5.

In order to render both a depth of field and three-dimensional configuration for design 3, portions of paint layer 7 are embedded into and below the surface of substrate 5 after the latter has been softened. This may be accomplished through the application of heat or an appropriate solvent to selected portions defining the outline of design 3, and thereafter embedding paints or other decorative materials within the softened portions of the substrate to produce an encapsulated composite structure. This is depicted in FIG. 1 wherein portions of paint layer 7 defining an edge portion 15 of design 3 have been embedded into and encapsulated within substrate 5. A reflective particulate material 17, such as metallic or plastic flakes, may also be applied with paint layer 7 and embedded into softened portions of substrate 5 in the same manner. As is apparent, light sources 9, 11 and 13 illuminate not only paint layers 7 applied to the surface of substrate 5, but also portions 15 and 17 of design 3 which have been encapsulated within substrate 5. This creates an extremely appealing depth of field and three-dimensional configuration to design 3.

Figure 2:
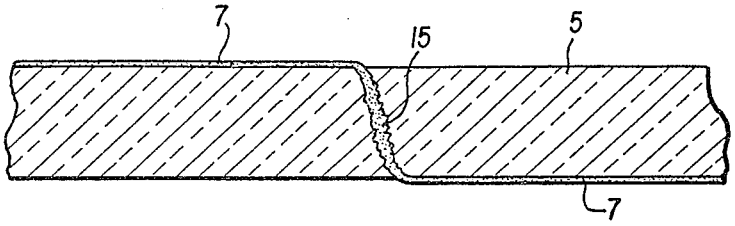
FIG. 2 is a fragmentary cross-sectional view of a painted art work made according to the invention wherein paint is applied to opposed surfaces of a light transparent substrate.

In another embodiment of the invention as shown in FIG. 2, paint layers 7 are applied to each of the two opposed surfaces of substrate 5, with portions 15 of paint encapsulated within substrate 5 and joining opposed layers 7. This provides an even further enhanced depth of field and three-dimensional configuration for design 3.

Figure 3:
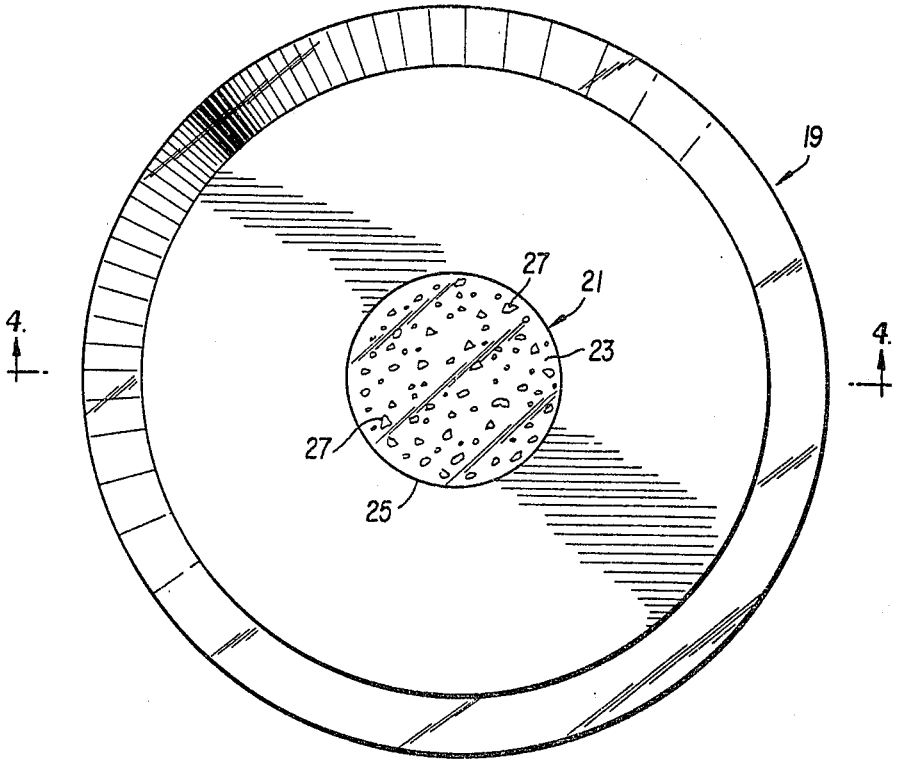
FIG. 3 is a plan view of a device for exhibiting an art work made according to the invention.
Figure 4:
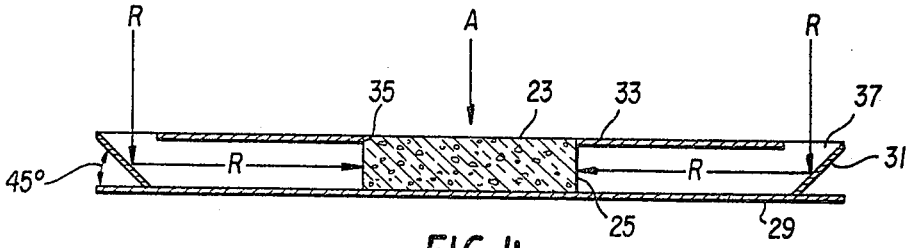
FIG. 4 is a cross-sectional view taken along the line 4—4 of FIG. 3.

Referring now to FIGS. 3 and 4, a device 19 is shown for displaying an art work 21 made according to the invention. Art work 21 comprises a round light transparent substrate in the form of a disk 23 made from acrylic or similar plastic material. Disk 23 includes a peripheral surface 25 on which paint may be applied and portions of which may be embedded in the manner previously described, with the exception being that the types of paints used are preferably substantially transparent or translucent to light transmission. Moreover, reflective particulate material 27, such as plastic or metallic flakes, may be encapsulated within disk 23 below selected portions of all exterior surfaces thereof.

As seen in FIG. 4, disk 23 is secured onto a flat base 29 through adhesive or the like. Base 29 may be of a circular configuration and provided with a corresponding circular-shaped reflector 31 disposed at an angle of approximately 45° with respect to the upper surface of base 29. A circular-shaped top 33 is disposed over base 29 and spaced therefrom a distance substantially equal to the thickness of disk 23. A circular opening 35 having a diameter substantially equal to that of disk 23 is provided in top 33 so that the entire exterior circular face of disk 23 may be viewed therethrough. Top 33 and base 29 are preferably constructed from opaque materials to prevent transmission of light therethrough. Top 33 may be secured directly to disk 23 or secured to base 29 through internal struts or bracing (not shown). Reflector 31 may be a glass mirror or any material provided with a suitable reflective coating thereon.

Light directed through an annular space 37 defined by the outer peripheral edges of top 33 and reflector 31 is reflected radially inwardly by reflector 31 from all directions towards the center portion of disk 23, as indicated by arrows R. In this manner, when art work 21 is viewed from a direction substantially perpendicular to the exposed surface of disk 23, as indicated by arrow A in FIG. 4, it is provided with optimal and intense illumination from reflector 31 to render an extremely pleasing depth of field and three-dimensional configuration to the design made according to the invention and displayed by art work 21.

Figure 5:
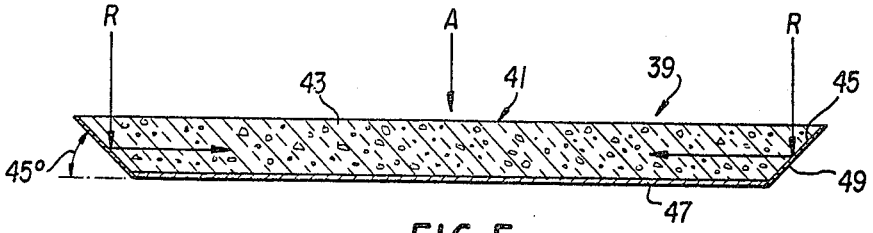
FIG. 5 is a cross-sectional view of another embodiment of a device for exhibiting an art work made according to the invention.

Another embodiment of a device for exhibiting an art work made according to the invention is shown in FIG. 5. In this embodiment, a device 39 is provided for displaying an art work 41 made according to the invention. Art work 41 comprises a substrate 43 in the form of a large circular disk of plastic material having a peripheral edge 45 that is beveled at an angle of approximately 45° with respect to a flat base 47 secured to the bottom of substrate 43. Edge 45 is provided with a reflective layer 49 of metal or other suitable reflective material so that light passing through substrate 43 adjacent the periphery thereof and in the direction designated by arrows R will be reflected off of reflective layer 49 and directed radially inwardly from all directions towards the center portion of substrate 43. It is preferred that base 47 be made from opaque material to prevent transmission of light therethrough. Substrate 43 is provided with a decorative design in accordance with the method of the invention. Art work 41 is viewed from the direction indicated by arrow A and is optimally illuminated throughout its entirety by light reflected inwardly from reflective layer 49.

The types of paint which can be used in the practice of the invention may be any that are well known in the art, such as emulsion-based paints and solvent-based paints. The paints may be used separately or blended together, or even blended with other suitable decorative materials, in order to achieve the desired effect. The substrate may be made from any plastic material, preferably thermoplastic type polymers, which is found suitable for permitting encapsulating paints and other decorative materials therein through the application of heat or solvents.

The encapsulation of painted designs within a suitable plastic substrate is accomplished by actually physically moving the plastic after it is softened by the application of heat or a solvent, such as toluene. It is preferred that an outline sketch or drawing of the anticipated design be initially applied on the surface of the plastic substrate prior to the application of heat or solvent. After softening the substrate at selected portions of the outline, the plastic is moved away to one side and thereby creates a void. The decorative materials, such as paints or reflective particles, may then be placed in the void. Thereafter, the plastic is carefully moved back over and against the decorative materials to form a permanent encapsulation thereof below the surface of the substrate. This latter step is accomplished slowly and carefully to prevent "sliding" of the coloring materials which causes distortion of the finished design.

The solvent may be applied by any tools well known in the art and deemed suitable for the aforedescribed function and purpose. When heat is utilized as the softening mechanism, it is preferred that resistance heated, thermocouple-controlled tools are used to provide controlled temperature conditions within the heating limitations of the plastic material being softened. It is also possible to use heated hollow needles that contain pigment or paint-like materials which are forced through the needles into the softened plastic. Unheated hollow needles containing paint-like materials may also be used to deposit such materials into plastic that has been initially softened through the application of a solvent.

Other suitable tools for practicing the invention may include heated or unheated tweezer-like instruments for the placement of solid decorative materials, such as reflective particles, within the softened substrate, and also solid heated and unheated needles for the blending of color and materials within the substrate and working the solvent into the plastic at selected areas. A heated surface leveling tool may be employed to assist in the encapsulation of the decorative materials below the surface of the substrate and provide a smooth exterior finish to the final product.

As is therefore apparent, the invention provides a form of creating and displaying art works in three dimensions and in a manner to yield artistic freedom in utilizing materials and lighting and, moreover, provides the realization of new disciplines in design configurations, such as clouds, smoke, elevation knoll changes or shape deviations.

While the invention has been described and illustrated with reference to certain preferred embodiments and conditions, it will be appreciated that various modifications, changes, additions, omissions and substitutions may be resorted to by those skilled in the art and considered to be within the spirit and scope of the invention and the appended claims.

What is claimed is:

1. A device for exhibiting a light transparent art work comprising:

(a) a pair of spaced substantially opaque planar members for enclosing the art work therebetween;

(b) one of the planar members including an aperture through which the art work may be viewed from a direction substantially perpendicular to such planar member;

(c) reflective means disposed around peripheral edges of the planar members for reflecting and directing light inwardly through the art work and towards opposed portions of the reflective means; and (d) whereby light and color patterns generated by the art work and the reflective means are viewable from a direction substantially perpendicular to the one planar member.

2. The device of claim 1 wherein the planar members are each of a substantially circular configuration and disposed parallel to each other.

3. The device of claim 2 wherein the reflective means includes a substantially continuous mirror disposed between the peripheral edges of the planar members.

4. The device of claim 3 wherein the mirror is carried by the other planar member and directed outwardly at an angle of approximately 45° with respect to the plane of the other planar member.

5. A device for exhibiting a light transparent art work comprising:

(a) a planar member for supporting the art work;

(b) the planar member including an outwardly directed peripheral edge disposed at approximately 45° with respect to the plane of the member;

(c) reflective means carried by the interior surface of the peripheral edge for reflecting and directing light inwardly through the art work and towards opposed portions of the reflective means; and (d) whereby light and color patterns generated by the art work in the reflective means are viewable from a direction substantially perpendicular to the planar member.

* * * * *